US006579065B2

(12) United States Patent
Scott et al.

(10) Patent No.: US 6,579,065 B2
(45) Date of Patent: Jun. 17, 2003

(54) METHODS AND APPARATUS FOR LIMITING FLUID FLOW BETWEEN ADJACENT ROTOR BLADES

(75) Inventors: Matthew Alban Scott, Mason, OH (US); Jay L. Cornell, Hamilton, OH (US); Robert Russell Grant, Mason, OH (US)

(73) Assignee: General Electric Co., Schnectady, NY (US)

( * ) Notice: Subject to any disclaimer, the term of this patent is extended or adjusted under 35 U.S.C. 154(b) by 6 days.

(21) Appl. No.: 09/951,912

(22) Filed: Sep. 13, 2001

(65) Prior Publication Data

US 2003/0049129 A1 Mar. 13, 2003

(51) Int. Cl.[7] ..... F01D 5/22
(52) U.S. Cl. ..... 416/193 A
(58) Field of Search ..... 416/193 A, 248

(56) References Cited

U.S. PATENT DOCUMENTS 4,743,166 A 5/1988 Elston, III et al.
4,767,267 A 8/1988 Salt et al.
4,872,812 A 10/1989 Hendley et al.
5,222,865 A 6/1993 Corsmeier
5,257,909 A 11/1993 Glynn et al.
5,277,548 A * 1/1994 Klein et al. ..... 416/193 A
5,302,086 A 4/1994 Kulesa et al.
5,599,170 A * 2/1997 Marchi et al. ..... 416/190
5,749,701 A 5/1998 Clarke et al.
6,217,283 B1 4/2001 Ravenhall et al.
6,220,815 B1 4/2001 Rainous et al.

* cited by examiner

*Primary Examiner*—Edward K. Look
*Assistant Examiner*—Kimya N McCoy
(74) *Attorney, Agent, or Firm*—Nathan D. Herkamp; Robert B. Reeser, II; Armstong Teasdale LLP

(57) ABSTRACT

A rotor assembly for a gas turbine engine includes a plurality of radially extending and circumferentially spaced rotor blades and a seal. Each of the blades includes a platform including a radially outer surface and a radially inner surface. The platform radially outer surface defines a surface for fluid flowing thereover. The seal includes at least one hollow member coupled to each rotor blade platform radially inner surface that is configured to reduce fluid flow through a gap defined between adjacent rotor blades.

18 Claims, 3 Drawing Sheets

METHODS AND APPARATUS FOR LIMITING FLUID FLOW BETWEEN ADJACENT ROTOR BLADES

BACKGROUND OF THE INVENTION

This invention relates generally to gas turbine engines, and more specifically to rotor blades used with gas turbine engines.

At least some known gas turbine engines include a rotor assembly including a row of rotor blades. The blades extend radially outward from a platform that extends between an airfoil portion of the blade and a dovetail portion of the blade, and defines a portion of the gas flow path through the engine. The dovetail couples each rotor blade to the rotor disk such that a radial clearance may be defined between each rotor blade platform and the rotor disk.

The rotor blades are circumferentially spaced such that a gap is defined between adjacent rotor blades. More specifically, a gap extends between each pair of adjacent rotor blade platforms. Because the platforms define a portion of the gas flow path through the engine, during engine operation fluid may flow through the gaps, resulting in blade air losses and decreased engine performance.

To facilitate reducing such blade air losses, at least some known rotor assemblies include a seal assembly coupled to the blade platform. More specifically, the known seal assemblies include a pair of cooperating seal members. The seal members are solid and extend radially inward from the platform into the radial clearance. The seal members are coupled to adjacent rotor blade platforms on opposite sides of a respective gap. An overall height of the seal members, measured with respect to the blade platform, is dependant upon a width of the respective gap defined between the blades. More specifically, as the width of the gap is increased, an overall height of the seal members is also increased.

During operation, as the rotor assembly rotates, circumferential loading is induced to the rotor assembly and causes the seal members to deflect towards each other. More specifically, the seal members deflect past the platform edges towards each other and across the gap to contact and to facilitate reducing fluid flow through the gap. However, depending upon a width of the gap and an elasticity of the seals, an amount of deflection between such seal assemblies may not adequately prevent fluid from flowing through the gap. The problem may be even more pronounced because the radial clearance defined between the rotor blades and the rotor disk may limit the height of the seal assembly members. Furthermore, at least some rotor assemblies include platform configurations that do not permit seal protrusion past the blade platform edges.

BRIEF DESCRIPTION OF THE INVENTION

In one aspect of the invention, a rotor assembly for a gas turbine engine is provided. The rotor assembly includes a plurality of radially extending and circumferentially spaced rotor blades and a seal. Each of the blades includes a platform including a radially outer surface and a radially inner surface. The platform radially outer surface defines a surface for fluid flowing thereover. The seal includes at least one hollow member that is coupled to each rotor blade platform radially inner surface and is configured to reduce fluid flow through a gap defined between adjacent rotor blades.

In another aspect, a method for assembling a rotor assembly for a gas turbine engine is provided. The method includes coupling a seal assembly including at least one hollow member to at least one rotor blade that includes an airfoil, a dovetail, and a platform extending therebetween, and coupling the rotor blades to a rotor disk such that adjacent blades define a gap.

In a further aspect, a gas turbine engine is provided that includes at least one rotor assembly including a row of rotor blades and a seal. The blades are circumferentially-spaced and define a gap therebetween. Each rotor blade includes a platform including a radially inner surface and a radially outer surface. The seal includes at least one hollow member that is coupled to each rotor blade platform.

DETAILED DESCRIPTION OF THE INVENTION

Figure 1:
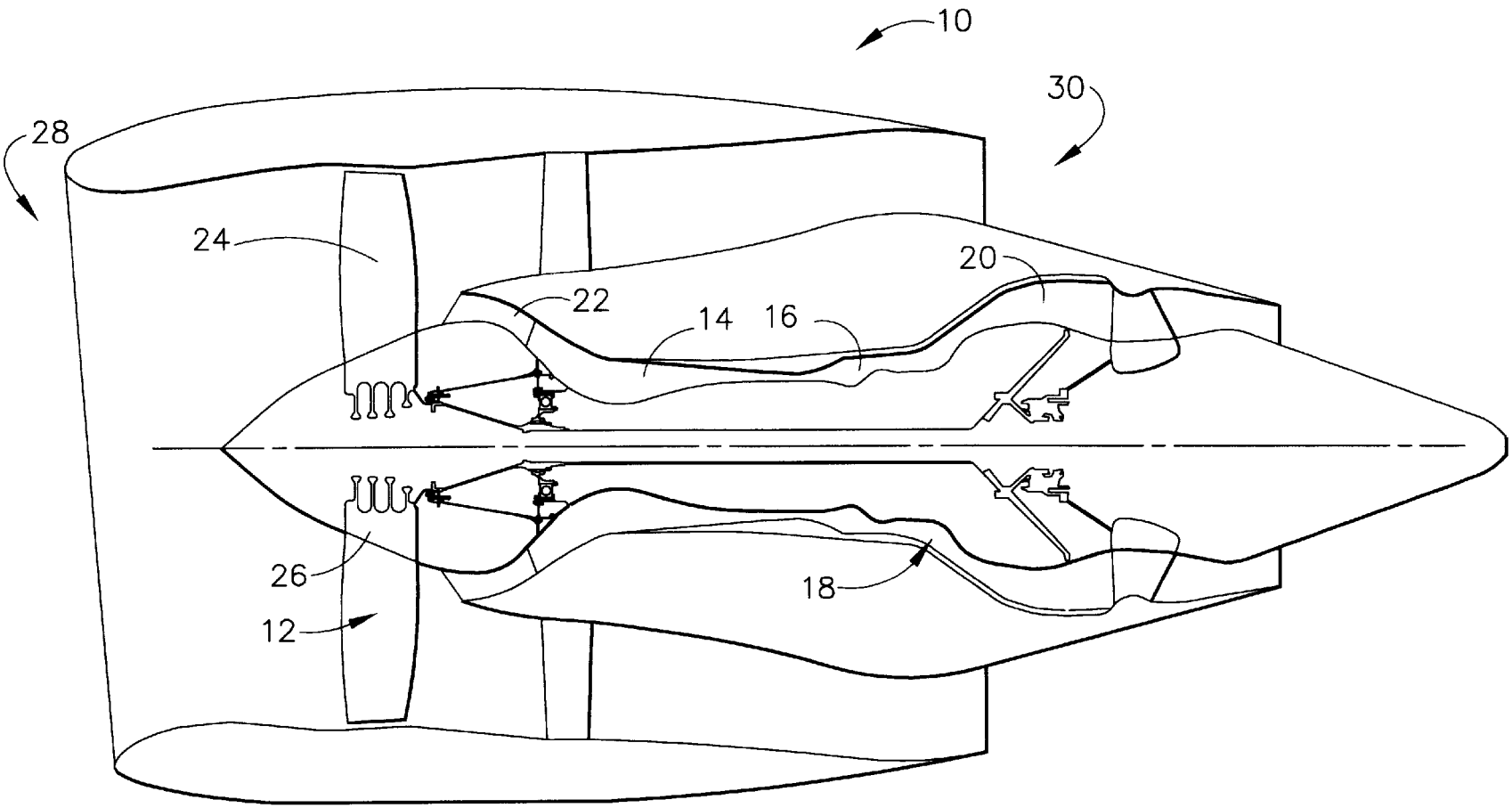
FIG. 1 is schematic illustration of a gas turbine engine.

FIG. 1 is a schematic illustration of a gas turbine engine 10 including a fan assembly 12, a high-pressure compressor 14, and a combustor 16. Engine 10 also includes a high-pressure turbine 18 and a low-pressure turbine 20. Engine 10 has an intake side 28 and an exhaust side 30. In one embodiment, engine 10 is a CF-34 engine commercially available from General Electric Aircraft Engines, Cincinnati, Ohio.

In operation, air flows through fan assembly 12 and compressed air is supplied to high-pressure compressor 14. The highly compressed air is delivered to combustor 16. Airflow from combustor 16 drives turbines 18 and 20, and turbine 20 drives fan assembly 12. Turbine 18 drives high-pressure compressor 14.

Figure 2:
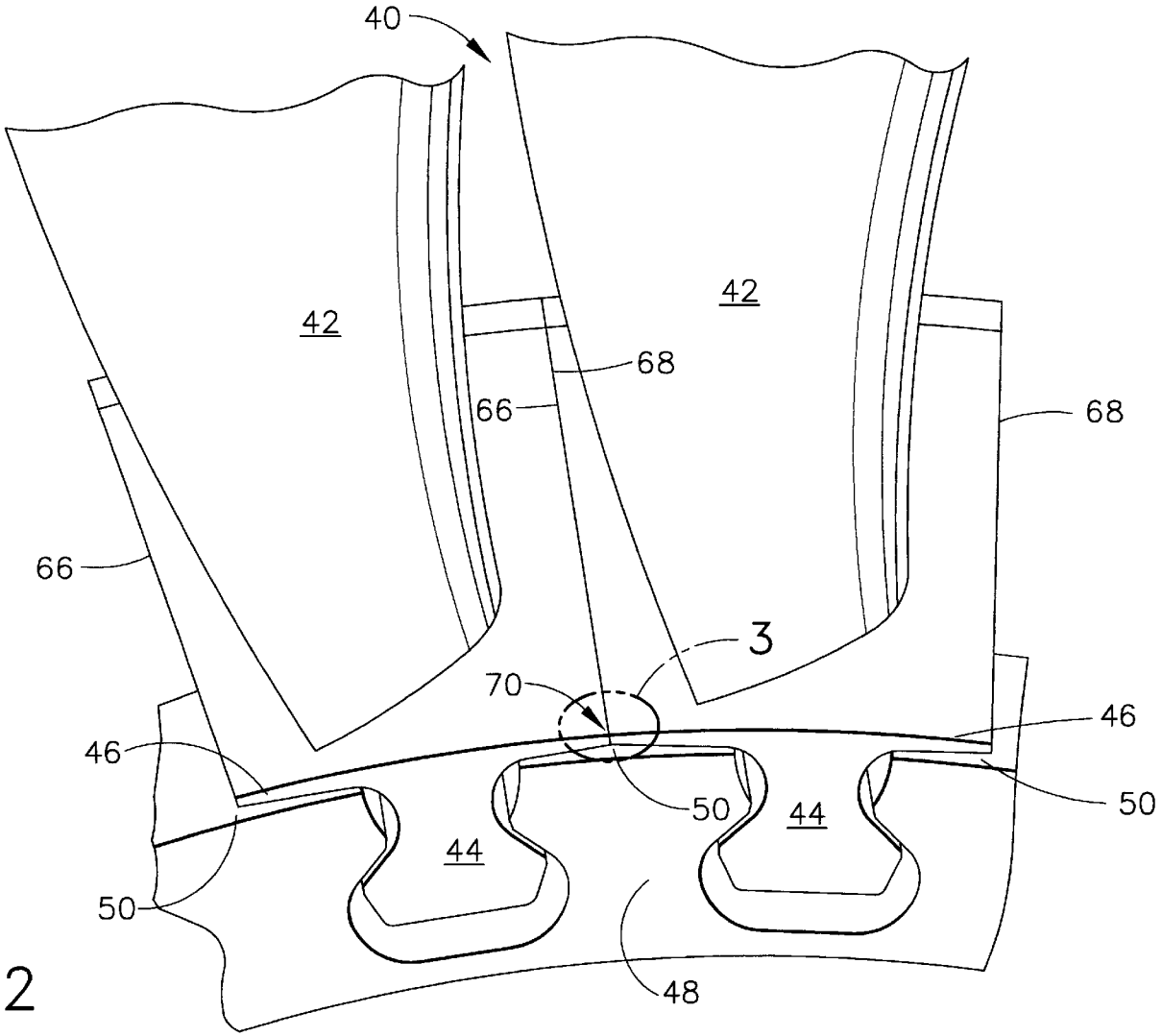
FIG. 2 is a partial front view of a row of blades that may be used with the gas turbine engine shown in FIG. 1.
Figure 3:
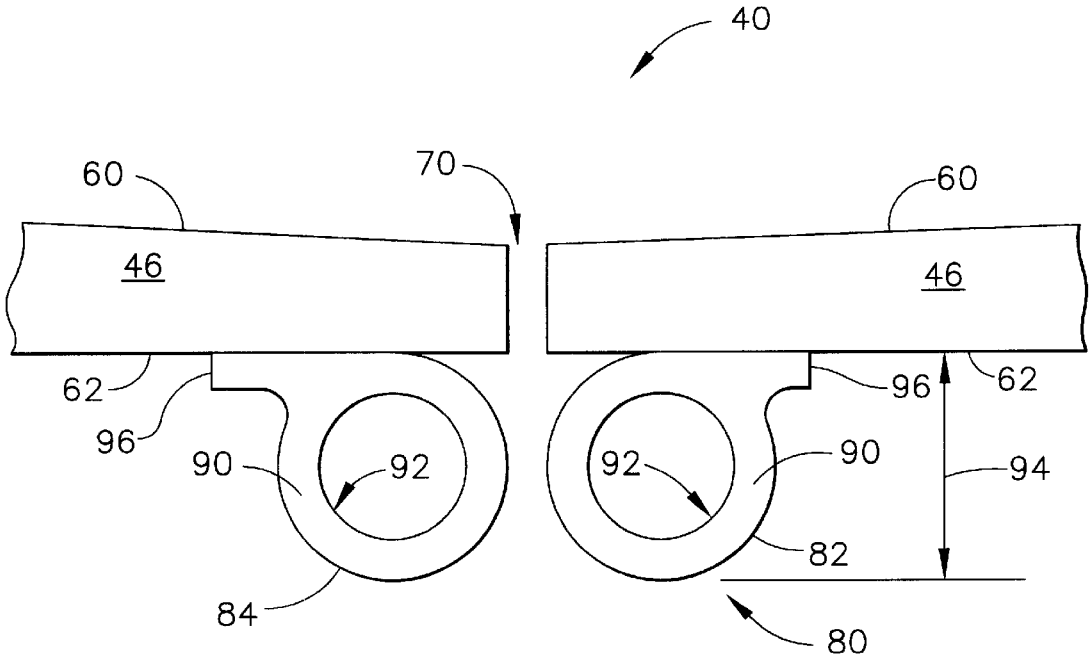
FIG. 3 is an exemplary enlarged view of a portion of the row of blades shown in FIG. 2 taken along area 3.

FIG. 2 is a partial front view of a row of blades 40 that may be used with gas turbine engine 10 (shown in FIG. 1). FIG. 3 is an exemplary enlarged view of a portion of blades 40 taken along area 3. In one embodiment, blades 40 form a blade stage within a compressor, such as compressor 14 (shown in FIG. 1). In another embodiment, blades 40 form a blade stage within a fan assembly, such as fan assembly 12 (shown in FIG. 1). Each blade 40 includes an airfoil 42, an integral dovetail 44, and a platform 46 that extends therebetween. Dovetail 44 is used for mounting airfoil 42 to a rotor disk 48 in a known manner, such that blade 40 is removably coupled to disk 48. When blade 40 is mounted in rotor disk 48, a radial clearance 50 is defined between each blade 40 and disk 48.

Blade platform 46 extends between dovetail 44 and airfoil 42, such that airfoil 42 extends radially outward from platform 46. Platform 46 includes an outer surface 60 and an inner surface 62. Outer surface 60 defines a portion of the gas flowpath through the gas turbine engine. Platform 46 also includes a pressure side outer edge 66 and a suction side outer edge 68.

Blades 40 extend circumferentially within the gas turbine engine and are circumferentially spaced, such that a clearance gap 70 is defined between adjacent blade platforms 46. More specifically, gap 70 extends between platform outer and inner surfaces 60 and 62, respectively, and provides a clearance that facilitates blades 40 being installed within, and/or removed from, rotor disk 48.

A seal assembly 80 is coupled to each rotor blade platform 46 to facilitate reducing fluid flow through each respective gap 70. More specifically, in the exemplary embodiment, seal assembly 80 includes a pair of seal members 82 and 84. Seal members 82 and 84 are each coupled to rotor blade platform inner surface 62 such that member 82 is adjacent platform pressure side edge 66, and member 84 is adjacent platform suction side edge 68.

In the exemplary embodiment, members 82 and 84 are identical, and each includes a hollow body 90 that defines a cavity 92 therein. Cavity 92 has a substantially circular cross-sectional profile. In an alternative embodiment, cavity 92 has a non-circular cross-sectional profile. Accordingly, members 82 and 84 have a reduced stiffness in comparison to solid members (not shown) that have the same cross-sectional profile and are fabricated from the same material. Members 82 and 84 are elastomeric members and have a height 94 extending from a base 96 of each member 82 and 84. Height 94 is variably selected based on radial clearance 50.

Member base 96 is coupled to platform inner surface 62 to secure members 82 and 84 to platform 46 such that seal assembly 80 does not interfere with the installation or replacement of rotor blades 40 within the gas turbine engine. In another embodiment, rotor blades 40 each include only member 84. In a further embodiment, members 82 and 84 are different, and either member 82 or 84 is a substantially solid member.

During engine operation, centrifugal loading induced to members 82 and 84 causes each member 82 and 84 to expand tangentially past each respective platform edge 66 and 68, and across each respective gap 70. Accordingly, members 82 and 84 cooperate to substantially seal gap 70 and thus, facilitate reducing fluid flow through gap 70. Furthermore, because fluid flow through gap 70 is substantially reduced and/or eliminated, an efficiency of the gas turbine engine is facilitated to be improved. In addition, because seal member height 94 is variably selected, rotor assembly radial clearances 50 are substantially eliminated as being limiting for seal assembly 80.

The above-described rotor blade seal assembly is cost-effective and highly reliable. The seal assembly includes at least one hollow member that expands tangentially during operation to seal a gap defined between adjacent rotor blades. The seal assembly members have a limited height that enables the seal to be coupled to rotor blades within narrow radial clearances. Because the seals substantially reduce or eliminate fluid flow through gaps defined between the rotor blades, the seals facilitate improving the gas turbine engine efficiency in a cost-effective and reliable manner.

While the invention has been described in terms of various specific embodiments, those skilled in the art will recognize that the invention can be practiced with modification within the spirit and scope of the claims.

What is claimed is:

1. A method for assembling a rotor assembly for a gas turbine engine, said method comprising:

coupling a seal assembly including at least one hollow first member adjacent a first respective gap and at least one second member adjacent a second respective gap to at least one rotor blade that includes an airfoil, a dovetail, and a platform extending therebetween; and coupling the rotor blades to a rotor disk such that adjacent blades define a gap.

2. A method in accordance with claim 1 wherein coupling a seal assembly further comprises coupling the hollow first member to an inner surface of the rotor blade platform and coupling the second member to an inner surface of the rotor blade platform, such that the first seal member and second seal member are between the platform and the rotor disk.

3. A method in accordance with claim 2 wherein coupling a seal assembly further comprises coupling a seal member having a substantially circular cross-sectional profile to the rotor blade platform.

4. A method in accordance with claim 1 wherein coupling a seal assembly further comprises coupling the first and second seal members such that the first member coupled to a first rotor blade is positioned to cooperate with a second member coupled to a second rotor blade.

5. A rotor assembly for a gas turbine engine, said rotor assembly comprising:

a plurality of radially extending and circumferentially-spaced rotor blades, each said blade comprising a platform comprising a radially outer surface and a radially inner surface, said platform radially outer surface defining a surface for fluid flowing thereover; and a seal comprising at least one hollow first member and at least one second member coupled to each said rotor blade platform radially inner surface and configured to reduce fluid flow through a gap defined between adjacent said rotor blades.

6. A rotor assembly in accordance with claim 5 wherein said plurality of rotor blades further comprise at least a first blade and a second blade, said first blade adjacent said second blade, said seal hollow first member coupled to said first blade platform and said second member coupled to said second blade such that said first hollow member and said second member are adjacent a respective gap defined between said first and second blades.

7. A rotor assembly in accordance with claim 5 wherein said seal hollow first member configured to expand tangentially across each said respective gap and cooperate with said second member during engine operation.

8. A rotor assembly in accordance with claim 5 wherein said seal further comprises a plurality of hollow first members and a plurality of second members coupled to each said rotor blade platform radially inner surface.

9. A rotor assembly in accordance with claim 5 wherein each said hollow first member has a substantially circular cross-sectional profile.

10. A rotor assembly in accordance with claim 5 wherein said seal further comprises at least one solid second member coupled to each said rotor blade platform radially inner surface.

11. A rotor assembly in accordance with claim 10 wherein said seal solid second members in close proximity to a respective gap, and configured to cooperate with a respective seal hollow first member coupled to an adjacent blade.

12. A gas turbine engine comprising at least one rotor assembly comprising a row of rotor blades and a seal, said blades circumferentially-spaced such that adjacent said blades define a gap therebetween, each said rotor blade comprising a platform comprising a radially inner surface and a radially outer surface, said seal comprising at least one hollow member coupled to each said rotor blade platform, wherein each said seal hollow member defines a cavity having a substantially circular cross sectional profile.

13. A gas turbine engine in accordance with claim 12 wherein each said rotor blade platform radially outer surface defines a portion of an engine fluid flow path, each said seal member coupled to each said rotor blade platform radially inner surface.

14. A gas turbine engine in accordance with claim 12 wherein said seal comprises a plurality of hollow members coupled to each said rotor blade platform.

15. A gas turbine engine in accordance with claim 12 wherein each said seal member configured to expand in a radial tangential direction across each respective gap during engine operation.

16. A gas turbine engine in accordance with claim 12 wherein each said seal member is configured to limit fluid flow through each said respective gap.

17. A gas turbine engine in accordance with claim 12 wherein said seal further comprises at least one solid second member coupled to each said rotor blade platform radially inner surface.

18. A gas turbine engine in accordance with claim 17 wherein said seal solid members in close proximity to a respective gap, and configured to cooperate with a respective seal hollow member coupled to an adjacent blade.

* * * * *